US005156035A

United States Patent [19]

Lampe et al.

[11] Patent Number: 5,156,035

[45] Date of Patent: Oct. 20, 1992

[54] METHOD AND APPARATUS FOR MANUFACTURING SEAMLESS TUBES

[75] Inventors: Alfred Lampe, Willich; Gheorghe Arnatu, Düsseldorf; Hermann J. Frentzen, Mönchen-gladbach, all of Fed. Rep. of Germany

[73] Assignee: Mannesmann Aktiengesellschaft, Dusseldorf, Fed. Rep. of Germany

[21] Appl. No.: 510,745

[22] Filed: Apr. 18, 1990

[30] Foreign Application Priority Data

Apr. 25, 1989 [DE] Fed. Rep. of Germany ..... 3914016

[51] Int. Cl.[5] ..... B21B 15/00; B21B 17/02

[52] U.S. Cl. ..... 72/206; 72/208; 72/370

[58] Field of Search ..... 72/206, 208, 209, 214, 72/220, 365.2, 366.2, 370, 224, 234, 235, 283

[56] References Cited

U.S. PATENT DOCUMENTS

| | | | |
|---|---|---|---|
| 948,961 | 2/1910 | Peters | 72/209 |
| 988,834 | 4/1911 | Stiefel | 72/209 |
| 1,283,692 | 11/1918 | Debenedetti | 72/206 |
| 2,083,698 | 6/1937 | Engelbertz | 72/370 |
| 3,661,005 | 5/1972 | Petersen et al. | 72/206 |

FOREIGN PATENT DOCUMENTS

| | | | |
|---|---|---|---|
| 0050112 | 3/1983 | Japan | 72/366.2 |
| 0116907 | 7/1983 | Japan | 72/235 |

*Primary Examiner*—Lowell A. Larson
*Assistant Examiner*—Thomas C. Schoeffler
*Attorney, Agent, or Firm*—Cohen, Pontani, Lieberman & Pavane

[57] ABSTRACT

Seamless tubes are manufactured from a hollow ingot introduced into a continuous-tube rolling mill. The hollow ingot is deformed, directly before introduction into a first stand of the rolling mill, so that without reduction in wall thickness the clearance between a mandrel and an inner surface of the hollow ingot in the region of a base of the groove of the rolls of the first stand is greater than the clearance in the region of roll flanks of the first stand. This advantageously increases the stretch in the first roll groove so that, on one hand, the total stretch limit can be increased and, on the other hand, the central roll groove can be relieved.

6 Claims, 5 Drawing Sheets

METHOD AND APPARATUS FOR MANUFACTURING SEAMLESS TUBES

BACKGROUND AND SUMMARY OF THE INVENTION

The present invention relates to a method and apparatus for manufacturing seamless tubes from a hollow ingot that is introduced into a continuous-tube rolling mill.

In continuous-tube rolling mills, reshaping of a hollow ingot into a continuous bloom in accordance with the prior art occurs in six to eight roll stands, the grooves of which form a groove row for a predetermined constant bloom outlet diameter (nominal caliber). All groove rows are, in principle, so shaped that a stepwise reduction in circumference is accomplished by a simultaneous decrease in the wall from the first to the last groove.

The design of a row of grooves always relates to the smallest bloom wall thickness that is associated with a rated caliber. By predetermining a corresponding stretch limit, this being understood as the ratio of the cross section of the hollow ingot to the cross section of the bloom, there are determined the diameter of the hollow ingot, which is constant for this row of grooves, and the smallest hollow ingot wall thickness required for the production of the smallest bloom wall thickness.

In accordance with the prior art, groove rolls with stretch limits of between 3.2 and 5.5 have recently been customary.

In calculating the diameter of the hollow ingot, process-dependent entrance and exit clearance values are to be taken into account. The entrance clearance (CH) is, in this regard, the difference between the inside diameter of the hollow ingot and the diameter of the mandrel. The size of the entrance clearance is determined in accordance with two different criteria. Thus, on one hand, the entrance clearance is to be selected so large that a required exit clearance is retained at the end of the deforming process so as to avoid the bloom shrinking onto the mandrel and to assure pulling of the mandrel from the bloom. On the other hand, the size of the entrance clearance results from the necessity of introducing the mandrel before the start of rolling into the hollow ingot and positioning it. In this connection, a layer of lubricant applied to the mandrel rod must remain intact and intensive local contact between the mandrel and the inner surface of the hollow ingot must be avoided before the start of the rolling process, since heat would thereby pass from the wall of the hollow ingot to the mandrel.

Particularly in the case of longer hollow ingots, sufficient linearity cannot always be assured in actual operation, so that the greatest possible entrance clearance CH is desired for the reasons indicated. Entrance clearance values of between 6.0 and 16.0 mm are known.

A large entrance clearance, however, has the considerable disadvantage that large stretching in the first groove, which is desirable for technological reasons, is substantially limited by a necessarily widely open grooving.

It is known to persons skilled in the art that the most favorable reshaping conditions are present in the first two roll grooves. Here, with a relatively thick entrance wall, it is possible to decrease wall thickness by more than 50% with relatively low resistance to change in form. The rate of change in shape is still small in the first roll groove, as is the relative speed between mandrel and material being rolled. In the second roll groove, a stretching on the order of magnitude of 1.6 can, for example, be obtained.

Starting from these problems and the disadvantages of the prior art, an object of the invention is to create a method and apparatus with which it is possible to increase the stretch in the first roll groove in order, on one hand, to increase the total stretch limit or to relieve the central roll groove.

Another object of the invention is to retain the entrance clearance values necessary for the process within suitable limits even in the case of increased stretch.

In order to achieve the foregoing objects, one form of the invention concerns a hollow ingot that is so predeformed directly before entry into the first stand of a continuous-tube rolling mill, without reduction in wall thickness, that the clearance between a mandrel and an inner surface of the hollow ingot is greater in the region of the bottom of the groove of the rolls of the first stand than the clearance in the region of roll flanks. Accordingly, the same conditions that result, on the basis of the grooving of traditional continuous-tube rolling mills, in the following stands of these mills are obtained for the entry of the hollow ingot into the first groove of the continuous-tube rolling mill. In this way the important advantage is obtained that an increase of the stretch in the first groove becomes possible, so as to permit a reduction of the total number of roll stands. This goal can be achieved by the invention in a manner that the hollow ingot is deformed in the manner proposed, for instance ovally.

In an advantageous further form of the invention, the degree of the mentioned deformation is selected so that the inner surface of the hollow ingot lies against the mandrel in the region of the roll flanks of the first stand.

In accordance with another feature of the invention, in the case of larger entrance clearance values the invention further relates to reducing in circumference simultaneously with the deforming the hollow ingot.

An apparatus for carrying out the method of the invention is characterized by a device, arranged directly in front of the first stand of the continuous rolling mill, for deforming the hollow ingot in at least one longitudinal central plane that extends offset (by 90° in the case of two-roll grooving) to the longitudinal central plane or planes of the hollow ingot which pass through the groove base of the rolls of the first roll stand of the continuous-tube train. A light-weight and cost-effective manner of construction then results if only ovalization is effected with narrow rolls of slight grooving.

If the continuous-tube rolling mill is provided with three-roll grooving, the device for deforming the hollow ingot is also equipped with three rolls.

In all cases, it is advisable to place the device for deforming the hollow ingot as close a possible to the first roll stand so that the hollow ingot is ovalized only shortly before the start of the rolling, and that the advantages of a large entrance clearance are retained. Since the device is embodied as a drive apparatus, the condition exists of adjusting the speed of the device to the rolling conditions, the force and power requirements of the device being advantageously correspondingly small since there is no reduction in the wall thickness.

BRIEF DESCRIPTION OF THE DRAWING FIGURES

One embodiment of the invention will be explained below with reference to the figures in the drawing. The relationship between entrance clearance and possible stretching in the first roll groove will also be shown on basis of a few views of grooves. In the drawing.

DETAILED DESCRIPTION OF THE PREFERRED EMBODIMENTS

Figure 1:
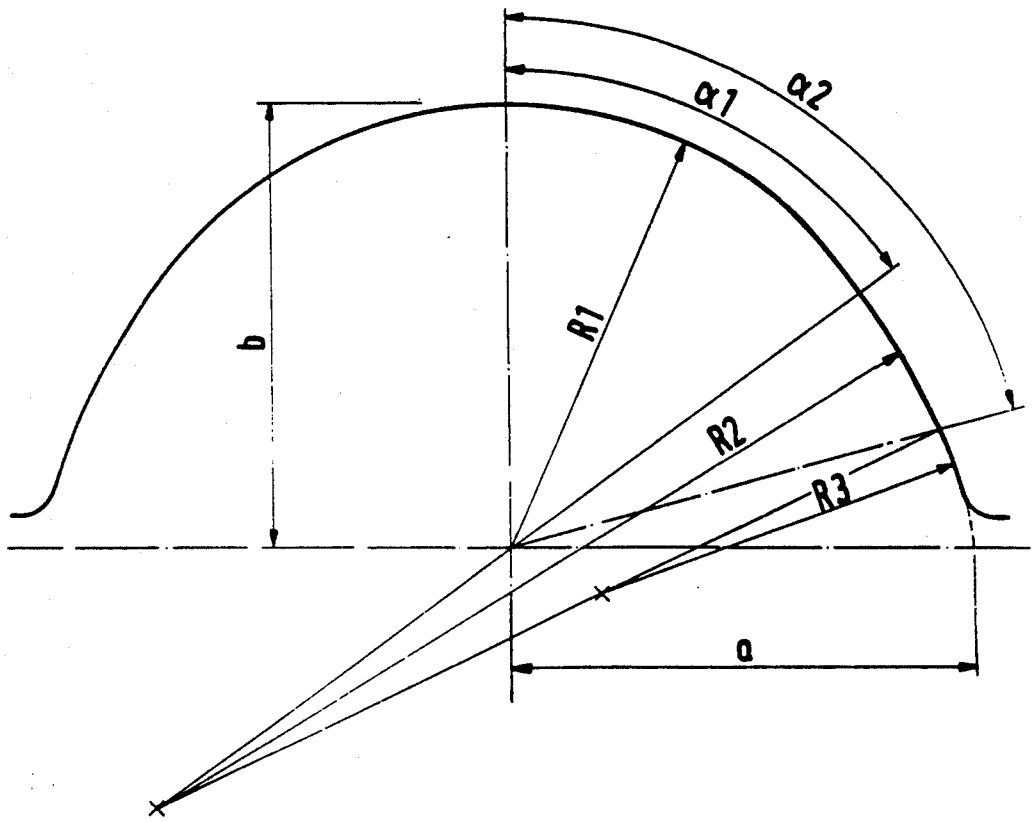
PRIOR ART Fig. 1
FIG. 1 shows the assumed groove shape of a roll of a continuous rolling mill.

In a normal case, the contour of a continuous groove that is cut into rolls is formed of circular arcs of different radii which, at their contour contact point, have a common tangent. FIG. 1 shows an assumed groove shape; R1 is the groove base radius and $\alpha 1$ the groove base angle. R3 in the figure is the flank radius. On the basis of FIG. 1, the expression "opening ratio=a/b" can also be explained. b is the distance from the center of the roll to the base of the groove; a is the distance from the center of the roll to the flank of the groove, it being assumed for determining a that the flank radius of the groove contour is extended up to the axis of the center of the roll.

From the figure it is clear that the size of the groove opening is adjustable by R2, but essentially also by the values of the angle $\alpha 1$. In other words, the opening ratio becomes smaller when $\alpha 1$ becomes larger.

As is known, the roll axes of successive roll stands are always offset with respect to each other. n this way, the bloom section rolled in the groove flank enters into the groove bottom of the following roll. For the opening conditions of the successive grooves there is the condition that a n is always equal to or greater than b n−1. For the exit cross sections which are ovalized to a greater or lesser extent in the grooves, this condition can easily be maintained. However, it exists also for the entrance of a round hollow ingot into the first roll groove. Thus a1 (see FIG. 2) must at be at least theoretically be equal to half of dH to avoid damage to the surface of the hollow ingot during the entrance process.

Figure 2:
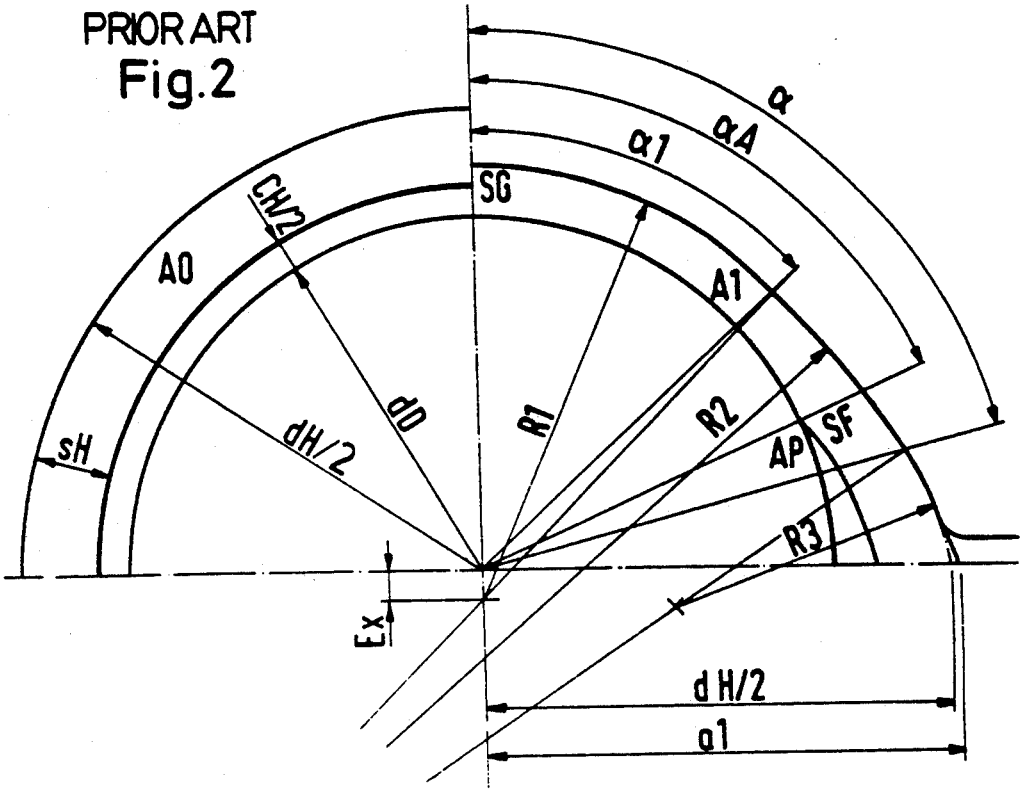
PRIOR ART Fig.2
FIGS. 2 and 3 show the conditions that result from different entrance clearances in the first stand of a row of grooves.
Figure 3:
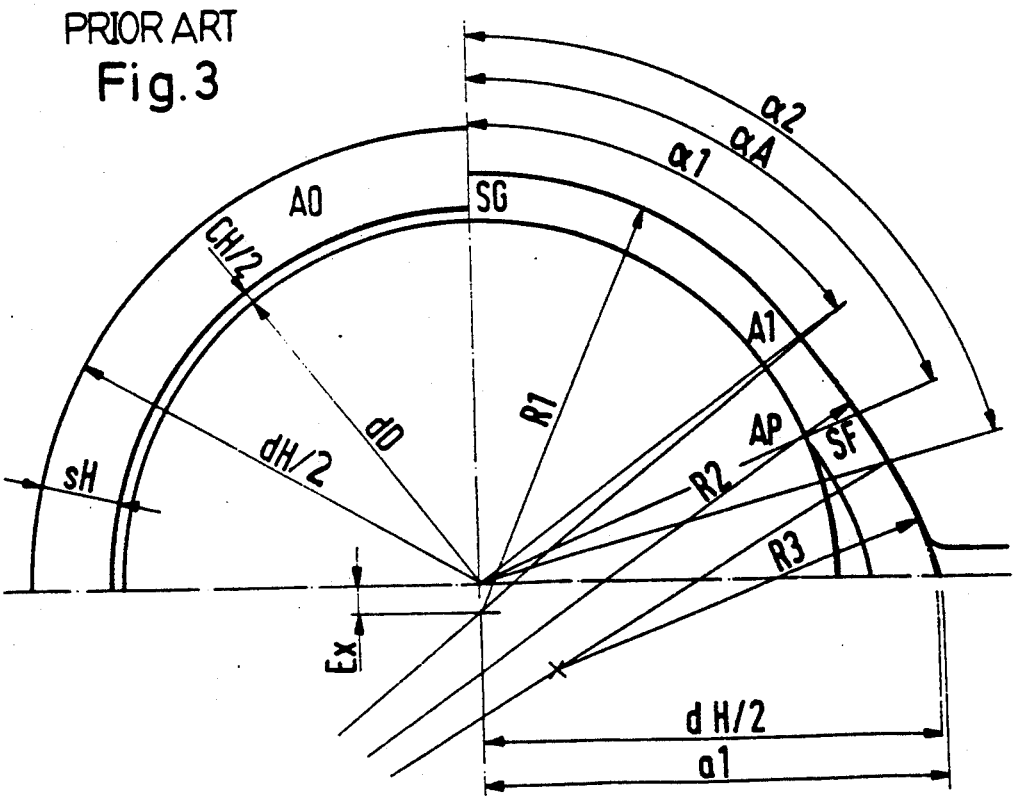
PRIOR ART Fig.3

In FIGS. 2 and 3, the conditions are shown which result in a different entrance clearance in the first stand of a groove roll. In FIGS. 2 and 3 on the left-hand side there can be noted the entering hollow ingot cross section and the pre-established entrance clearance, and on the right-hand side the roll nip that results between groove contour and mandrel surface. Differing from the general showing of FIG. 1, the radius point for R1 does not coincide with the center of the roll but is shifted by Ex. This is necessary in order to obtain the necessary large opening ratio in a first groove. In this way, the wall thickness SG is not constant over the groove base angle $\alpha 1$. In FIGS. 2 and 3 the radii and angles are so selected that the condition $a1 > dH/2$ is satisfied.

In FIG. 3, with smaller dH/2, the groove base angle $\alpha 1$ could be increased and the opening ratio a1 to b1 decreased. In the figures, a flank wall thickness SF hat is associated with a mandrel detachment point AP and a detachment angle is shown alongside the groove base wall thickness SG.

Figure 4:
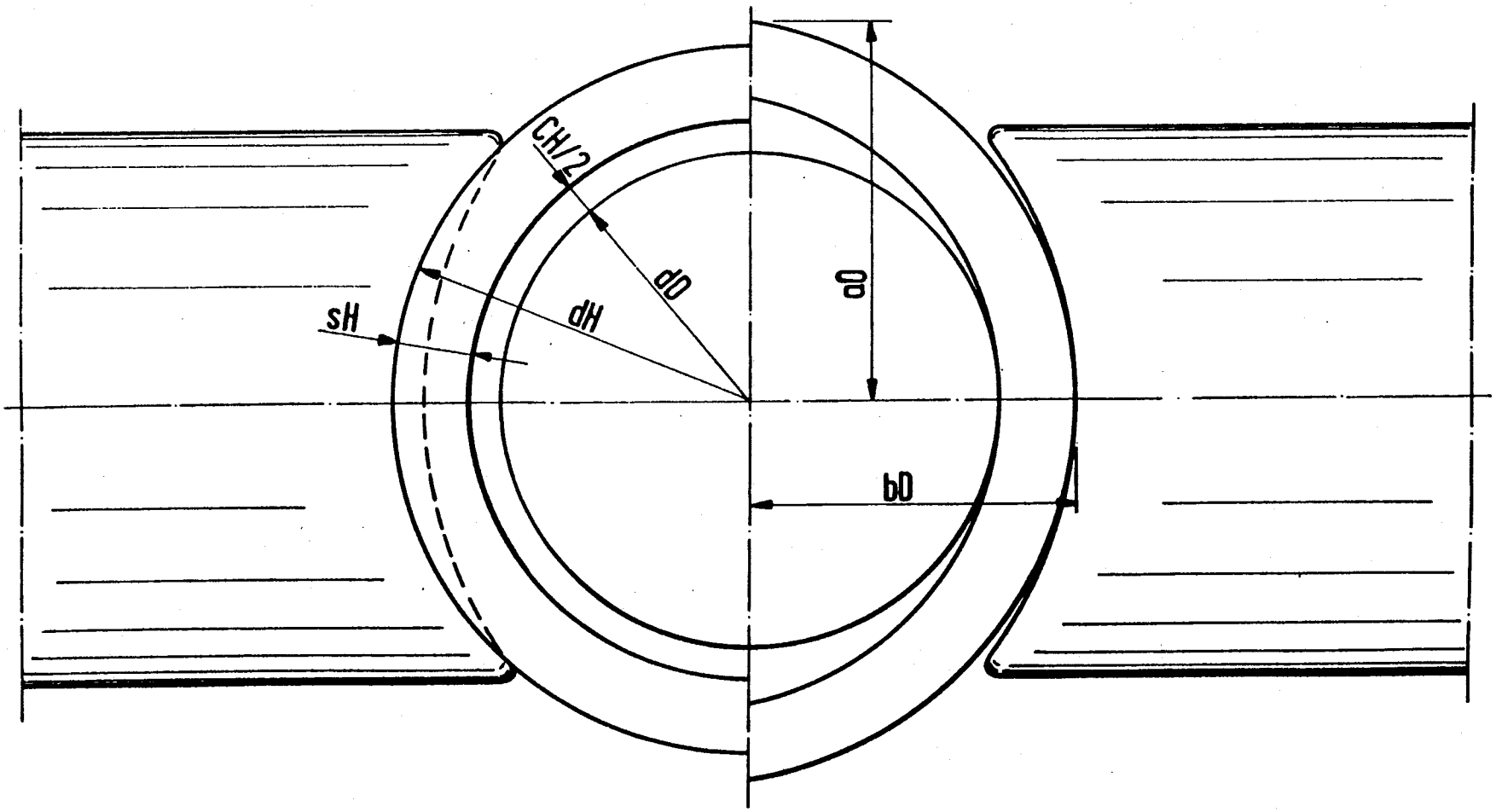
FIG. 4 shows a simple ovalizing of a hollow ingot with narrow profiled drive rolls.

It is assumed here, by way of simplification, that SF remains constant as from the detachment point AP and follows the contour of the groove. The groove is divided by the angle $\alpha A$ into a region of forced reshaping and a region of free reshaping. In a greatly simplified fashion, one could assume that SF corresponds to the entrance wall thickness SH; this assumption is impermissible, however, since the forced wall decrease and the stretching of the material resulting therefrom also effects a decrease of the wall in the free deforming zone. The complicated functions determining the detachment point AP and SF cannot be shown here. Since the size of the groove base angle $\alpha 1$ plays a substantial role for the change of SF, the trend of the variable SF is shown in FIGS. 2 and 3. The stretching of a groove always results from the ratio of entrance cross section to exit cross section. With the cross sectional surfaces A0 and A1 shown, it is seen in FIG. 3 that a more uniform wall thickness and a slightly greater stretch is obtained with small entrance clearance. The stretch obtained, however, does not correspond to the existing form-changing ability of the first continuous groove. The invention provides for ovalizing the entering hollow ingot in such manner that its diameter is compressed between two slightly profiled rolls by the amount of the existing input clearance. These conditions are shown in FIG. 4. An apparatus necessary for this purpose can be viewed as a drive apparatus with adjustable rolls. It is important to place the apparatus as close as possible to the first roll stand so that the hollow ingot is ovalized only shortly before the start of the rolling in order to obtain the advantages of a large entrance clearance. If large entrance clearance values are desired, the apparatus can be developed in a correspondingly heavier type also with roll grooving which, in addition to the ovalizing, also effects a certain reduction in circumference. Such conditions are shown in FIG. 5.

Figure 5:
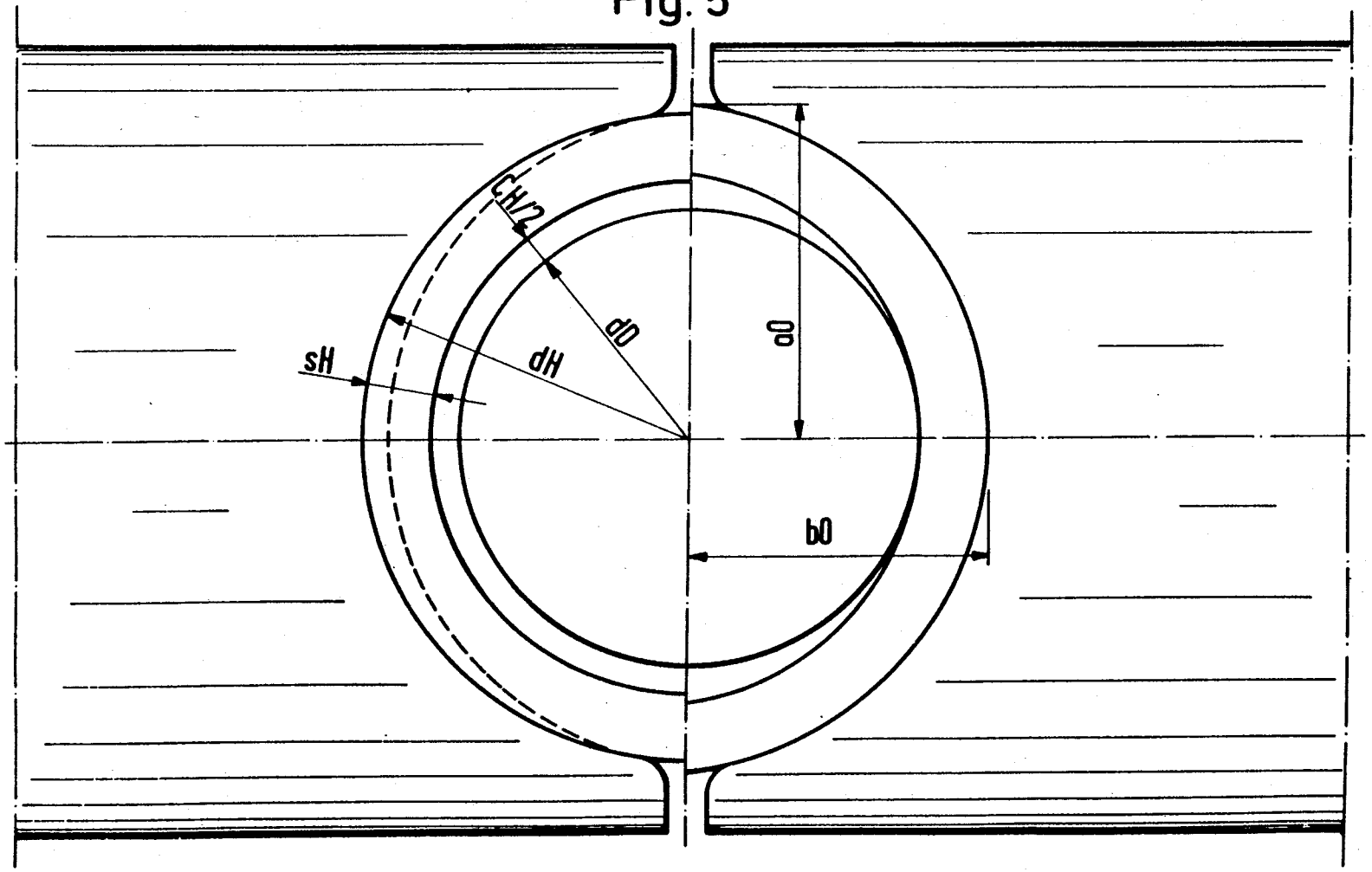
FIG. 5 shows ovalizing of the same hollow ingot with simultaneous reduction of circumference with correspondingly calibrated wider drive rolls.
Figure 6:
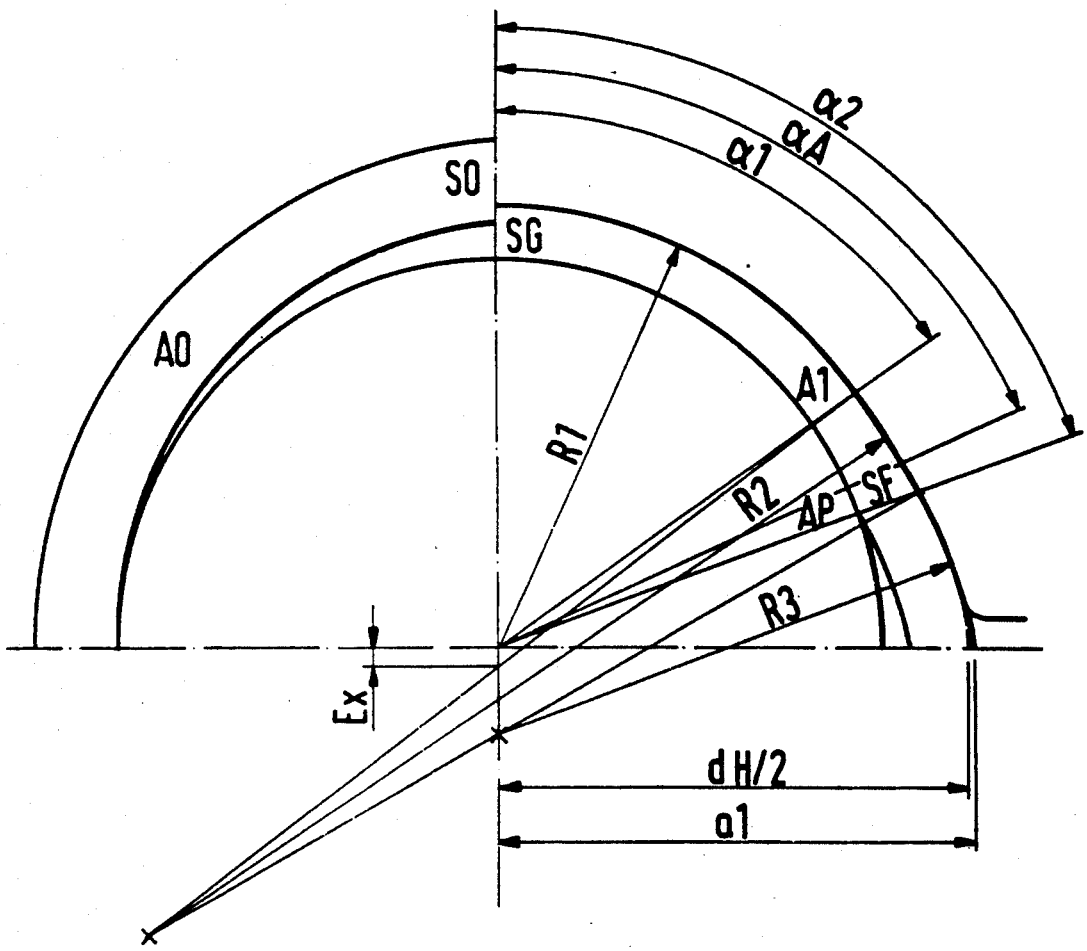
FIG. 6 shows a possible groove design for the first groove upon the use of a hollow ingot ovalized in accordance with FIG. 5.

FIG. 6 shows a possible groove construction resulting from the use of a hollow ingot ovalized in accordance with FIG. 5. With ovalizing of the hollow ingot, the same entrance conditions are established for the first groove as for the other grooves. The increase in the stretch can be clearly noted from the ratio of the areas.

It should be understood that the preferred embodiments and examples described are for illustrative purposes only and are not to be construed as limiting the scope of the present invention which is properly delineated only in the appended claims.

What is claimed is:

1. A method for manufacturing seamless tubes from a hollow ingot utilizing a mandrel, a deforming means and a multi-stand rolling mill, wherein:

said hollow ingot has an inner surface, an outer surface, a wall thickness, an inside diameter and an outside diameter;

said mandrel has an outer surface and a diameter, such that the mandrel diameter is smaller than the inside diameter of the hollow ingot;

said deforming means has deforming surfaces wherein a distance between the mandrel surface and each deforming surface is not less than the wall thickness of the hollow ingot as it enters the deforming means; and said multi-stand rolling mill has a first stand with grooved rolls defining a roll pass with a center, each roll having a groove base with a rolling surface and roll flanks, wherein a distance from the center of the roll pass to the roll flanks is less than or equal to one half of the outside diameter of the hollow ingot in the regions of the roll flanks of the rolls;

wherein said method comprises performing in the following order the steps of:

(a) deforming the hollow ingot in the deforming means, so that:

(i) the wall thickness of the deformed hollow ingot is substantially the same as the wall thickness of the undeformed hollow ingot;

(ii) an entrance clearance of the deformed hollow ingot, defined as a difference between the inside diameter of a hollow ingot and the diameter of the mandrel in a region of the groove base of each roll of the first stand, is greater than an entrance clearance in a region of the roll flanks of each roll of the first stand; and (iii) the distance from the center of the roll pass of the first stand to the roll flanks is equal to at least one half of the outside diameter of the deformed hollow ingot in the regions of each of the roll flanks of the rolls;

(b) introducing the deformed hollow ingot into the first stand of the rolling mill; and (c) reducing the wall thickness of the deformed hollow ingot in the first stand of the rolling mill by rolling the deformed hollow ingot through the grooved rolls of the first stand, wherein a distance between the mandrel surface and the rolling surface of each roll is less than a wall thickness of the deformed hollow ingot as it enters the first stand.

2. A method of manufacturing seamless tubes according to claim 1, wherein tools for effecting the deforming are so adjusted that the inner surface of the hollow ingot rests against the mandrel in the region of the roll flanks of the first stand.

3. A method of manufacturing seamless tubes according to claim 2, wherein the deforming tools are so grooved that a reduction in circumference of the hollow ingot is effected during the deforming step.

4. An apparatus for manufacturing seamless tubes from a hollow ingot having an inner surface, an outer surface, a wall thickness, an inside diameter and an outside diameter, in a multi stand rolling mill, comprising:

(a) a mandrel having an outer surface and a diameter, such that the mandrel diameter is smaller than the inside diameter of the hollow ingot;

(b) a deforming means having deforming surfaces for deforming the hollow ingot; and (c) a multi-stand rolling mill, located immediately adjacent and downstream of said deforming means, having an entrance portion for receiving the deformed hollow ingot from said deforming means, a first stand with grooved rolls defining a roll pass with a center, each roll having a groove base with a rolling surface and roll flanks, wherein a distance from the center of the roll pass to the roll flanks is less than or equal to one half of the outside diameter of the hollow ingot in regions of each of said roll flanks of said rolls, said first stand reducing a wall thickness of said deformed hollow ingot by rolling the deformed hollow ingot through said grooved rolls of said first stand, wherein a distance between said mandrel surface and said rolling surface of each roll is less than a wall thickness of the deformed hollow ingot, said deforming means deforming the hollow ingot so that:

(i) a distance between said mandrel surface and each deforming surface is not less than the wall thickness of the hollow ingot as it enters said deforming means, so that the wall thickness of the deformed hollow ingot is substantially the same as the wall thickness of the undeformed hollow ingot;

(ii) an entrance clearance of the deformed hollow ingot, defined as a difference between the inside diameter of a hollow ingot and said diameter of said mandrel, in said region of said groove base of each roll of said first stand is greater than an entrance clearance in a region of said roll flanks of each roll of said first stand; and (iii) a distance from the center of the roll pass of the first stand to the roll flanks is equal to at least one half of the outside diameter of the deformed hollow ingot in regions of the roll flanks of the rolls.

5. An apparatus according to claim 4, wherein the deforming means comprises a two-roll stand with adjustable rolls.

6. An apparatus according to claim 4, wherein:

said deforming means is positioned in front of a continuous-tube rolling mill with three-roll grooving; and said deforming means comprises three rolls.

* * * * *